US009713381B2

(12) United States Patent
Davis et al.

(10) Patent No.: US 9,713,381 B2
(45) Date of Patent: Jul. 25, 2017

(54) CHAIR

(71) Applicant: Davis Furniture Industries, Inc., High Point, NC (US)

(72) Inventors: Daniel K. Davis, High Point, NC (US); William R. Easton, High Point, NC (US); Jonathan Prestwich, London (GB); Hermann Bock, Pyrbaum (DE)

(73) Assignee: Davis Furniture Industries, Inc., High Point, NC (US)

( * ) Notice: Subject to any disclaimer, the term of this patent is extended or adjusted under 35 U.S.C. 154(b) by 54 days.

(21) Appl. No.: 14/736,348

(22) Filed: Jun. 11, 2015

(65) Prior Publication Data

US 2016/0360887 A1 Dec. 15, 2016

(51) Int. Cl.

| | |
|---|---|
| ***A47C 1/02*** | (2006.01) |
| ***A47C 1/032*** | (2006.01) |
| ***A47C 7/00*** | (2006.01) |

(52) U.S. Cl.

CPC ..... *A47C 1/03261* (2013.01); *A47C 1/03255* (2013.01); *A47C 1/03277* (2013.01); *A47C 7/004* (2013.01); *A47C 1/02* (2013.01); *A47C 1/032* (2013.01)

(58) Field of Classification Search

CPC ..... A47C 1/03261; A47C 1/03255; A47C 1/03277; A47C 7/004; A47C 7/443; A47C 7/441; A47C 1/032; A47C 1/02

USPC ..... 297/300.5, 300.2, 300.1, 302.1

See application file for complete search history.

(56) References Cited

U.S. PATENT DOCUMENTS

| | | | | |
|---|---|---|---|---|
| 809,944 A | | 1/1906 | Hanger | |
| 2,400,588 A | | 5/1946 | McArthur | |
| 2,859,801 A | * | 11/1958 | Moore | A47C 1/03255 297/322 |
| 2,863,495 A | * | 12/1958 | Knabusch | A47C 1/036 297/322 |
| 3,934,932 A | | 1/1976 | Ekornes | |
| 4,000,925 A | | 1/1977 | Doerr et al. | |
| 4,067,610 A | | 1/1978 | Doerr et al. | |

(Continued)

FOREIGN PATENT DOCUMENTS

| | | | | |
|---|---|---|---|---|
| DE | 3735256 A1 | * | 4/1989 | A47C 1/0325 |
| DE | 102008011309 | | 6/2009 | A47C 1/03255 |

(Continued)

OTHER PUBLICATIONS

Allsteel Clarity, http://www.allsteeloffice.com/products/seating/multi-purpose/clarity#tab=Media, known at least as early May 21, 2015, last viewed Aug. 20, 2015, 1 pg.

(Continued)

*Primary Examiner* — Syed A Islam

(74) *Attorney, Agent, or Firm* — MacCord Macon PLLC

(57) ABSTRACT

This disclosure describes a chair having a base frame, a seat support, and a backrest support. The seat support is connected to the backrest support. The backrest support is rotatably connected to a rear part of the base frame such that a pivot axis is defined about which the backrest support is pivotable. The seat support is connected to a front part of the base frame by at least one four-joint coupling mechanism, whereby the seat support is moved on a defined movement path in the chair longitudinal direction during a pivoting movement of the backrest support.

18 Claims, 6 Drawing Sheets

(56) References Cited

U.S. PATENT DOCUMENTS

| | | | | | |
|---|---|---|---|---|---|
| 4,438,978 | A | | 3/1984 | Arild | |
| 4,451,085 | A | | 5/1984 | Franck et al. | |
| 4,547,017 | A | * | 10/1985 | Lescure | A47C 1/03294 297/318 |
| 4,607,883 | A | | 8/1986 | Tzu-Chun | |
| 4,718,725 | A | * | 1/1988 | Suhr | A47C 1/03222 297/300.3 |
| 4,783,121 | A | | 11/1988 | Luyk et al. | |
| 4,840,426 | A | | 6/1989 | Vogtherr et al. | |
| 4,848,837 | A | * | 7/1989 | Volkle | A47C 1/031 297/300.1 |
| 4,962,962 | A | * | 10/1990 | Machate | A47C 1/03255 297/300.5 |
| 4,966,411 | A | | 10/1990 | Katagiri et al. | 297/301 |
| 4,984,846 | A | | 1/1991 | Ekornes | |
| 4,988,145 | A | | 1/1991 | Engel | |
| 5,005,905 | A | | 4/1991 | Sondergedl | |
| 5,203,853 | A | | 4/1993 | Caruso | |
| 5,209,548 | A | | 5/1993 | Locher | |
| 5,251,958 | A | * | 10/1993 | Roericht | A47C 1/03255 297/321 |
| 5,308,145 | A | * | 5/1994 | Koepke | A47C 1/03255 297/316 |
| 5,314,237 | A | * | 5/1994 | Koepke | A47C 1/03294 297/318 |
| 5,338,094 | A | | 8/1994 | Perry | |
| 5,472,261 | A | | 12/1995 | Oplenskdal et al. | |
| 5,486,035 | A | * | 1/1996 | Koepke | A47C 31/126 297/300.1 |
| 5,582,459 | A | | 12/1996 | Hama et al. | |
| 5,584,533 | A | * | 12/1996 | Schrewe | A47C 1/03255 297/300.2 |
| 5,601,336 | A | | 2/1997 | Troyas-Bermejo | |
| 5,603,551 | A | | 2/1997 | Sheehan | |
| 5,716,099 | A | * | 2/1998 | McDiarmid | A47C 1/031 297/284.11 |
| 5,775,774 | A | * | 7/1998 | Okano | A47C 1/03255 297/300.2 |
| 5,810,438 | A | | 9/1998 | Newhouse | |
| 5,810,440 | A | | 9/1998 | Unwalla | |
| 5,868,468 | A | * | 2/1999 | Wang | A47C 3/04 297/239 |
| 6,027,169 | A | | 2/2000 | Roslund, Jr. | |
| 6,065,803 | A | | 5/2000 | Li et al. | |
| 6,234,573 | B1 | | 5/2001 | Roder et al. | |
| 6,238,000 | B1 | | 5/2001 | Hallmark et al. | |
| 6,382,724 | B1 | | 5/2002 | Piretti | |
| 6,394,549 | B1 | | 5/2002 | DeKraker et al. | |
| 6,513,874 | B1 | | 2/2003 | Sander et al. | |
| 6,523,896 | B1 | | 2/2003 | Uhlenbrock | |
| 6,554,360 | B1 | * | 4/2003 | Wilke | B60N 2/0284 297/284.4 |
| 6,644,741 | B2 | | 11/2003 | Nelson et al. | |
| 6,709,057 | B2 | | 3/2004 | Sander et al. | |
| 6,709,058 | B1 | | 3/2004 | Diffrient | |
| 6,896,329 | B2 | | 5/2005 | Sander et al. | |
| 6,923,503 | B2 | | 8/2005 | Sangiorgio | |
| 6,959,965 | B2 | | 11/2005 | Diffrient | |
| 6,969,116 | B2 | | 11/2005 | Machael et al. | |
| 7,021,712 | B2 | | 4/2006 | Spendlove et al. | |
| 7,159,943 | B2 | | 1/2007 | Costaglia et al. | |
| 7,188,900 | B1 | | 3/2007 | Raftery | |
| 7,249,802 | B2 | | 7/2007 | Schmitz et al. | |
| 7,360,835 | B2 | | 4/2008 | Tubergen et al. | |
| 7,416,256 | B2 | | 8/2008 | Fujita et al. | |
| 7,425,037 | B2 | | 9/2008 | Schmitz et al. | |
| 7,431,397 | B2 | | 10/2008 | Link | |
| 7,594,700 | B2 | | 9/2009 | Stumpf et al. | |
| 7,837,265 | B2 | | 11/2010 | Machael et al. | |
| 7,841,666 | B2 | | 11/2010 | Schmitz et al. | |
| 8,061,775 | B2 | * | 11/2011 | Diffrient | A47C 1/03255 297/300.1 |
| 8,070,230 | B2 | | 12/2011 | Krob et al. | |
| 8,272,692 | B1 | * | 9/2012 | Epperson | A47C 1/03272 297/296 |
| 8,297,701 | B2 | | 10/2012 | Machael et al. | |
| 8,646,839 | B2 | | 2/2014 | Moreschi | |
| 8,777,312 | B2 | | 7/2014 | Diffrient | |
| 8,888,183 | B2 | | 11/2014 | Parker et al. | |
| 2005/0035638 | A1 | | 2/2005 | Pennington et al. | |
| 2006/0181128 | A1 | | 8/2006 | Takeuchi et al. | |
| 2009/0212617 | A1 | | 8/2009 | Krob et al. | 297/316 |
| 2009/0242700 | A1 | | 10/2009 | Raymond | |
| 2010/0084904 | A1 | * | 4/2010 | Erker | A47C 1/03255 297/340 |
| 2014/0077555 | A1 | | 3/2014 | Battey et al. | |

FOREIGN PATENT DOCUMENTS

| | | | |
|---|---|---|---|
| EP | 0339089 | 11/1989 | A47C 1/0325 |
| JP | S47017567 | 9/1972 | |
| JP | S50152905 | 12/1975 | |
| WO | WO 9300842 | 1/1993 | A47C 1/035 |

OTHER PUBLICATIONS

Herman Miller Equa 2 Chair, http://www.hermanmiller.com/content/hermanmiller/northamerica/en_us/home/design-resources/images.html?text=Herman Miller:Products/Equa 2 Chairs, known at least as early as May 21, 2015, last viewed Aug. 20, 2015, 2 pgs.

Herman Miller Setu, http://www.setuofficechair.co.uk/Setu_Kinematic_Spine.cfm, known at least as early as May 21, 2015, last viewed Aug. 20, 2015, 2 pgs.

Vitra Physix, http://pure.imm-cologne.com/2013/07/physix-by-vitra-more-than-the-sum-of-its-parts/, known at least as early as May 21, 2015, last viewed Aug. 20, 2015, 3 pgs.

Wilkhahn FS Chair, http://www.wilkhahn.com/en/products/office-swivel-chairs/fs-line/?utm_source=Archiexpo&amp%3Butm_medium=Product&amp%3Butm_campaign=Archiexpo&amp%3BcHash=ff9afb550a1d790f2d7a9d2a525862f8&cHash=07f408583254faef35a4846c0472df0e, known at least as early as May 21, 2015, last viewed Aug. 20, 2015, 1 pg.

Wilkhahn Picto, http://ecodesign.lboro.ac.uk/index.php?section=158, known at least as early as May 21, 2015, last viewed Aug. 20, 2015, 2 pgs.

* cited by examiner

CHAIR

FIELD OF INVENTION

This disclosure relates to chairs, in particular office chairs, allowing motion of a seat support relative to a chair column.

BACKGROUND

Rocker mechanisms for office chairs are known from the prior art. These are assemblies of relatively simple construction in the seat substructure of chairs in which a backrest support is rigidly connected to a seat support of the chair. The seat support-backrest support combination thus formed can, by means of the rocker mechanism, which connects the seat support-backrest support combination to the chair vertical column, be pivoted rearward about a pivot axis running perpendicular to the chair longitudinal direction when the user of the chair leans on the backrest. Only very simple movements can be realized by means of rocker mechanisms of said type. Thus, when the occupant leans rearwardly, both the back and seat tilt, maintaining the same angle therebetween.

Further, synchronous rocker mechanisms are known from the prior art. These are to be understood to mean assemblies in the seat substructure of chairs, which assemblies serve to realize a coupled-together kinematic mechanism which provides a certain movement of the seat part and backrest relative to one another. By means of these synchronous mechanisms, while both the seat part and the backrest are moved, the movement may be in a different controlled path. On the seat support there is mounted the seat, which is generally provided with a cushioned seat surface. The backrest support, which customarily extends rearward and upwardly relative to the seat support, bears the backrest of the chair.

To realize the desired synchronous movement of seat support and backrest support, it is customarily the case in such synchronous mechanisms that the seat support and backrest support are articulately coupled, either directly to one another or with the aid of additional coupling elements. Such synchronous mechanisms are used in particular in office chairs. They are generally of complex construction, expensive to produce and cumbersome to assemble.

SUMMARY

The present disclosure provides a chair that, in a relatively simple manner in terms of construction, exhibits the same or approximately the same functionality as a chair equipped with a conventional synchronous mechanism.

A chair according to the present disclosure may include a seat support connected to a backrest support. The backrest support may be rotatably connected to a rear part of a base frame, whereby a pivot axis is defined about which the backrest support is pivotable. The seat support may be connected to a front part of the base frame by at least one four-joint coupling mechanism (sometimes referred to herein as a double motion link mechanism), whereby the seat support is moved in a defined movement path in the chair longitudinal direction during, and responsive to, a pivoting movement of the backrest support.

Here, the expressions rear, front, etc. relate in each case to the chair longitudinal direction. The chair longitudinal direction is generally perpendicular to a center line of the backrest or backrest support. In other words, a person seated in the chair and facing straight ahead would be generally facing along the chair longitudinal direction.

In some embodiments the rigid connection between a seat support and a backrest support, such as is known from conventional rocker mechanisms, is replaced with a simple resilient connection. In this way, with a simple structural design, a movement profile can be realized which corresponds to the movement profile of a synchronous mechanism.

In some embodiments, the four-joint coupling mechanism connecting the seat support to the base frame allows a movement path of the seat support which can be defined in a particularly precise manner. In other words, by way of the four-joint coupling mechanism, the seat support can be guided in a particularly precise manner on a desired path when the backrest support induces a movement of the seat support owing to a user of the chair performing a leaning-back movement.

Chairs of the present disclosure may provide a particularly high level of seat comfort without the need to resort to more cumbersome and expensive solutions. It is a further advantage that the chair is not only of particularly simple construction but can also be produced inexpensively. Furthermore, relatively simple and rapid assembly is possible.

Embodiments of the present disclosure provide a self-adjusting chair mechanism, in the case of which the user of the chair lifts themselves upward by exerting a load on the backrest. In other words, when actuating the mechanism by pushing the backrest backward, the user acts against their own weight bearing on the seat. The desired pivoting resistance of the backrest is thus, in effect, set automatically owing to the weight of the user. Whereas conventional self-adjusting mechanisms are normally composed of a multiplicity of interacting components, the solution according to the disclosed chairs is of relatively simple construction.

In one embodiment, the at least one four-joint coupling mechanism is in the form of a double motion link mechanism. In this case, the two elements mounted on the base frame can perform only a swinging movement. By means of the double motion link mechanism, a point connected to the coupling element, in this case the articulation point of the seat support, can be guided along a defined forward and upward path.

The two motion links of the double motion link mechanism are rotatably mounted by way of their bearing ends on the front part of the base frame with the formation of positionally fixed bearing points, whereas the free ends of the two motion links are rotatably connected to a movable coupling element. This coupling element may be in the form of an arm which extends forward as viewed in the chair longitudinal direction and which is rotatably connected to the seat support, whereby an axis of rotation of the seat support, which axis of rotation is movable in the chair longitudinal direction, is defined.

The two motion links of the double motion link mechanism perform a forward pivoting movement about their bearing points during and responsive to a rearward pivoting movement of the backrest support.

The double motion link mechanism is designed such that, during a rearward pivoting movement of the backrest support, the axis of rotation of the seat support moves forward and upward on a substantially rectilinear movement path.

The movement path is inclined with respect to the horizontal, in particular if the substantially rectilinear movement path runs with a uniform upward inclination in the forward direction. In this case, the movement path preferably encloses an angle of 10 to 15 degrees with the horizontal.

The pivot axis formed by the connection of the backrest support to the rear part of the base frame is positionally fixed.

The connecting element connects the seat support to the backrest support such that a movement of one of the two parts induces a non-identical consequential movement of the respective other part.

In a further embodiment, a spring mechanism having at least one spring element is provided, which connects the base frame to the seat support. The spring element assists the movement of the combination of seat support and backrest support. Said at least one spring element is preferably a tension spring, by means of which the pivoting resistance of the backrest support can be set.

BRIEF DESCRIPTION OF THE DRAWINGS

An exemplary embodiment will be discussed in more detail below on the basis of the drawings, in which.

DETAILED DESCRIPTION

Here, all of the figures show the invention not true to scale but merely schematically, and only with the major constituent parts thereof. Here, the same reference signs are used to denote elements of identical or similar function.

Figure 1:
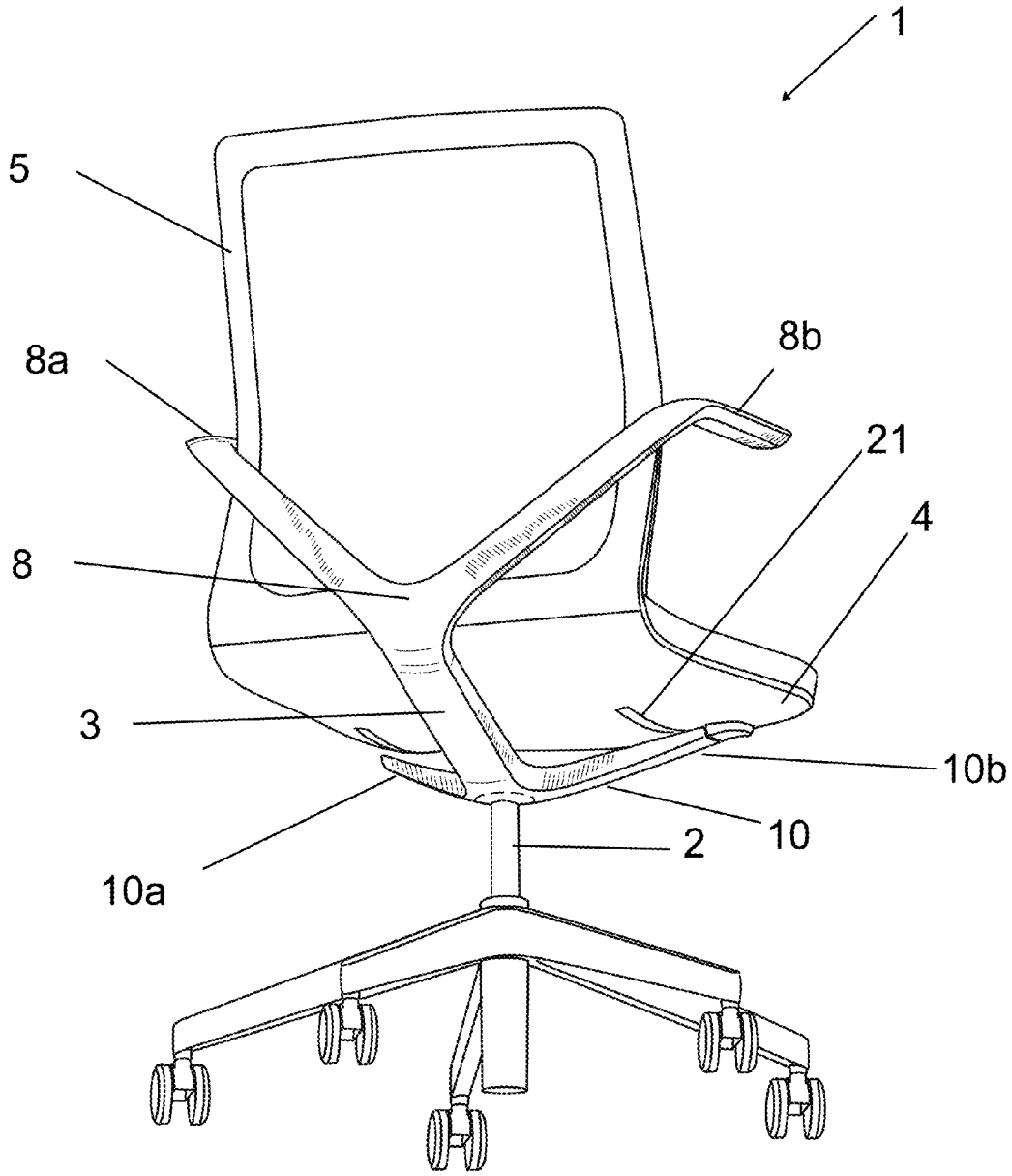
FIG. 1 shows a rear perspective of the chair.
Figure 2:
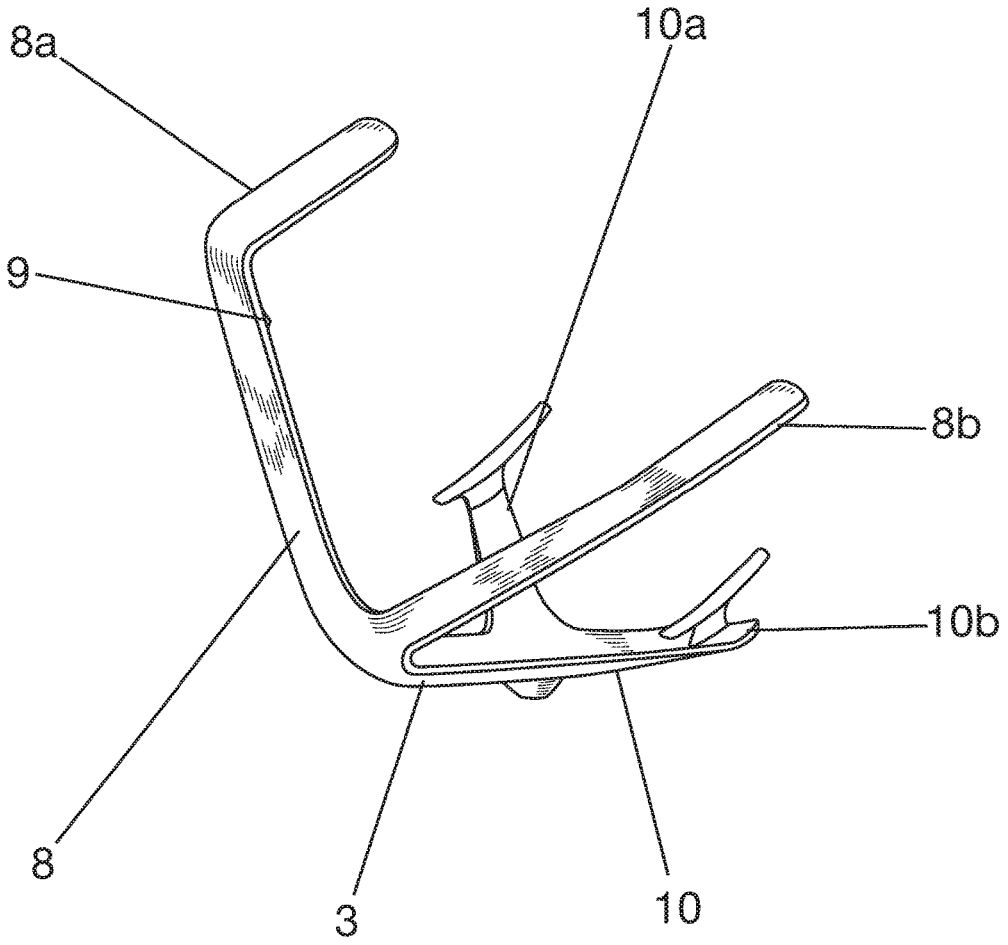
FIG. 2 shows a rear perspective of the base frame.

An office chair 1 according to the invention comprises, as illustrated in FIG. 1, a base frame 3 mounted on a chair column 2, a seat support 4, and a backrest support 5. As seen in FIGS. 1 and 2, the base frame 3 includes a rear part 8 that may branch into a pair of chair arms 8*a*, 8*b*. The front part 10 of the base frame 3 may include a pair of extensions 10*a*, 10*b*.

Figure 3:
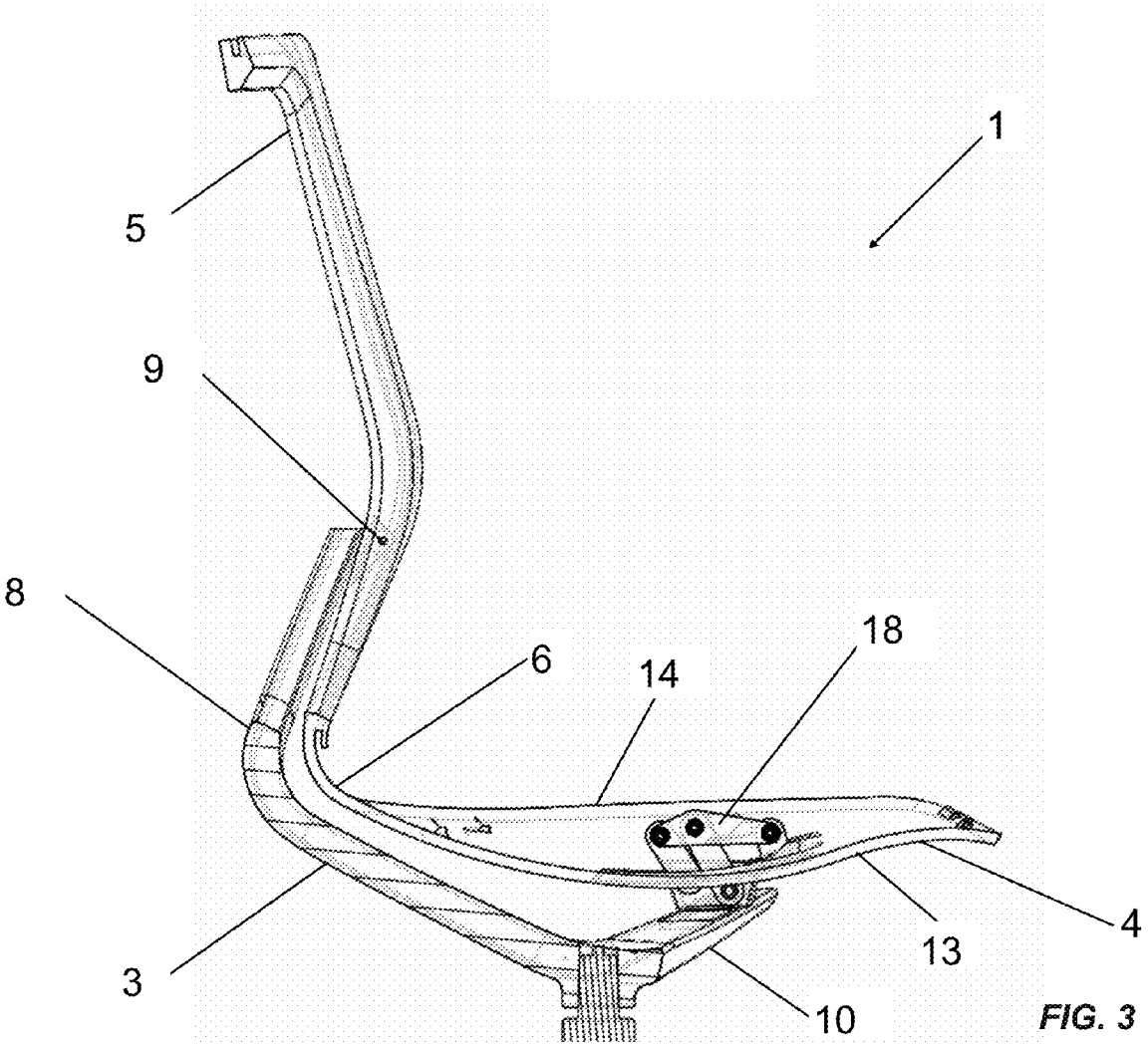
FIG. 3 shows a cross sectional view of the chair through a central plane along the longitudinal direction.
Figure 4:
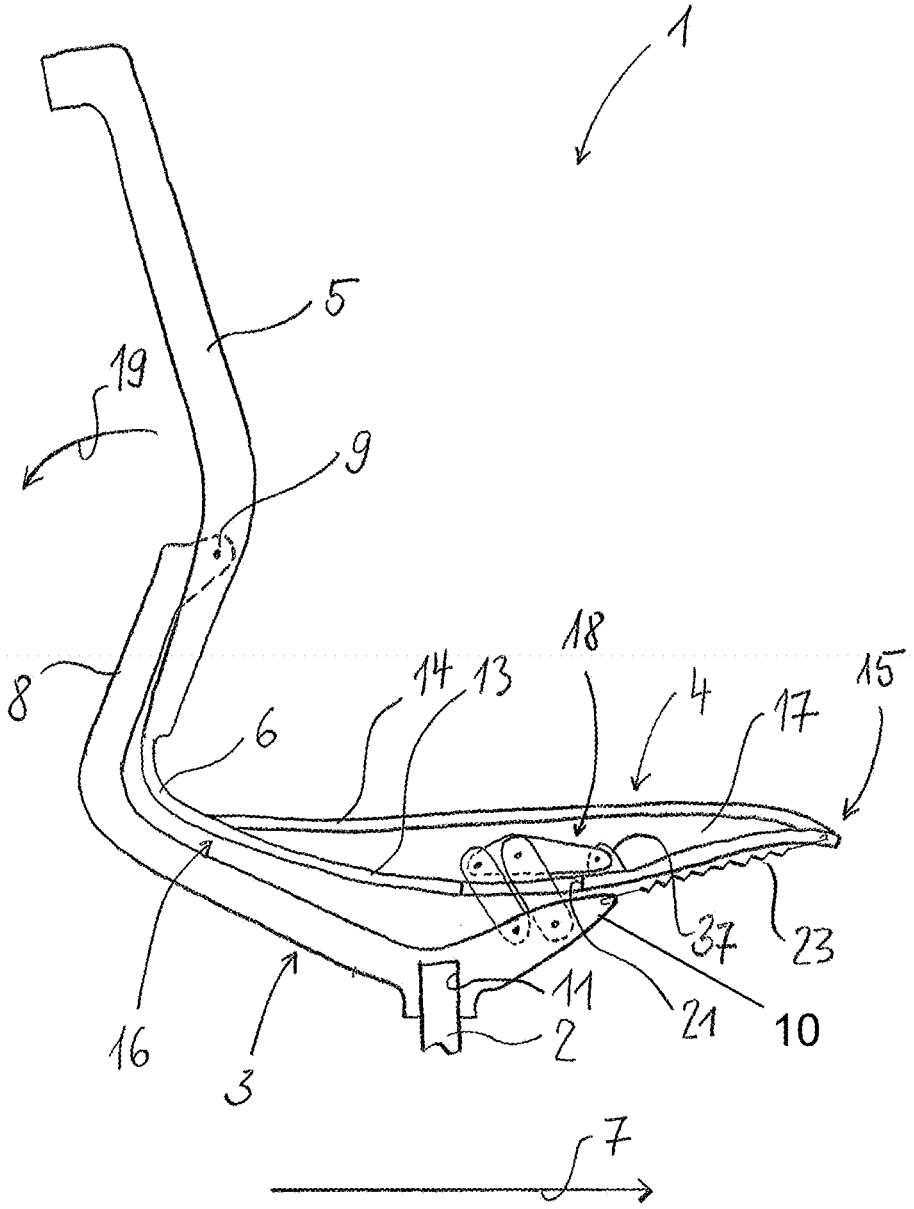
FIG. 4 schematically shows a partial section of the chair in longitudinal section in the normal upright position.

As best seen in FIGS. 3 and 4, the seat support 4 is connected to the backrest support 5 byway of a curved resilient connecting element 6. The backrest support 5 is rotatably connected to a rear part 8 of the base frame 3 as viewed in the chair longitudinal direction 7. The rear part 8 provides a positionally fixed pivot axis 9 formed between the backrest support 5 and the rear part 8 of the support frame 3, about which the backrest support 5 can be pivoted. The rear part 8 of the base frame 3 extends rearward and upward proceeding from a front part 10 of the base frame 3, which has the receiving opening 11 for the chair column 2.

The pivot axis 9 is thus situated a considerable distance above the seat support 4, in the region of the lower half of the backrest support 5. The pivot axis 9 runs perpendicular to the chair longitudinal direction 7.

The seat support 4 comprises a lower shell 13 and an upper shell 14. The upper shell 14 is connected to the lower shell 13 at the front end 15 of the seat support 4 and at the rear end 16 of the seat support 4. Between the lower shell 13 and upper shell 14 there is a receiving chamber 17. The lower shell 13 may extend as a direct elongation of the connecting element 6 and serves for the connection of the seat support 4 to the base frame 3. The upper shell 14 may serve for supporting a seat cushion.

Preferably, the seat support 4 is connected to each extension 10*a*, 10*b* of the front part 10 of the base frame 3 as viewed in the chair longitudinal direction 7 byway of a four-joint coupling mechanism which is configured as a double motion link mechanism 18. In this way, the seat support 4 is moved on a defined movement path 20 (see FIG. 5) (forward and upward) in the chair longitudinal direction 7 when the backrest support 5 is pivoted rearward and downward in the pivoting direction 19. The double motion link mechanism 18 may extend through an opening 21 formed in the lower shell 13.

The entire pivoting mechanism may be, as regards the kinematic arrangement thereof, of mirror-symmetrical construction about its central longitudinal plane. In this respect, in this description, it should be understood that structural elements can be provided in pairwise fashion at both sides. For example, a first double motion link mechanism 18 may be assigned to the right-hand side of the chair 1 through a first extension 10*a*, and a second double motion link mechanism may be assigned to the left-hand side of the chair 1 through a second extension 10*b*; the backrest support 5 can have a twofold articulated connection to the base frame 3 etc. (see FIGS. 1 and 2), wherein FIGS. 3 and 4 illustrate only the structural elements assigned to one half of the chair.

The connecting element 6 connects the seat support 4 to the backrest support 5 such that a movement of one of the two parts induces a non-identical consequential movement of the respective other part. In the exemplary embodiment shown here, the seat support 4 and backrest support 5 form a structural unit, but are movable relative to one another rather than being rigidly connected to one another. The seat support 4 and the backrest support 5 in this embodiment are directly linked via the elastic connecting element 6. In other embodiments a rotary joint, hinge, or pivot joint may be used to connect the seat support 4 to the backrest support 5.

Furthermore, a spring mechanism having at least one spring element can be provided. The spring mechanism can include tension springs 23 which connect the base frame 3 to the seat support 4. FIG. 4 symbolically illustrates the tension spring 23 being arranged between the front part 10 of the base frame 3 and the front part 15 of the seat support 4. The spring mechanism serves to assist or influence the pivoting resistance of the backrest support 5 and/or to prevent the backrest support 5 from tilting rearward in uncontrolled fashion, and for reliably returning the backrest support 5 from a pivoted position into the initial position when the user no longer exerts load on the backrest.

The double motion link mechanism 18 connected to the base frame 3 projects through the opening 21 in the lower shell 13 into the receiving chamber 17 between the lower shell 13 and upper shell 14 of the seat support 4. As best seen in FIGS. 5-8, the two motion links 24, 25 of the double motion link mechanism 18 are in this case rotatably mounted by way of their bearing ends 26, 27 on the front part 10 of the base frame 3, with the formation of spaced-apart, positionally fixed bearing points 28, 29. The free ends 30, 31 of the two motion links 24, 25 are rotatably connected to a movable coupling element 34 at spaced-apart articulation points 32, 33. The coupling element 34 has an elongation in the form of an arm 35 which extends forward as viewed in the chair longitudinal direction 7 and which is rotatably connected to the seat support 4. In the illustrated embodiment, the front end 36 of the arm 35 is rotatably connected to an actuation section 37 of the seat support 4. The actuation section 37 may be rigidly connected to the lower shell 13 of the seat support 4 to project upwardly away from the lower shell 13. Connection between the actuation section 37 and the front end 36 defines an axis of rotation 38 of the seat support 4, which axis of rotation 38 is movable in the chair longitudinal direction 7. In this case, like all the other axes of rotation and pivot axes, the axis of rotation 38 runs perpendicular to the chair longitudinal direction 7.

To realize a particularly stable construction, the coupling element 34 maybe manufactured from two congruent components which are arranged on the articulation points 32, 33 so as to be spaced apart from one another by means of spacers and which receive the two motion links 24, 25 between them.

By means of the arrangement of the coupling elements 34 of the double motion link mechanisms 18 arranged to the right and to the left on the base frame 3, and the configuration thereof, the synchronous movement of the seat support 4 can be individually adapted to the demands placed on the office chair 1. For example, by changing the lengths of the coupling elements 34 and/or the angular positions thereof, it is possible to define the extent to which the seat support 4 is tilted during a pivoting movement of the backrest support 5, and/or the extent to which the seat support 4 is displaced horizontally forward relative to the base frame 3 as viewed in the chair longitudinal direction 7.

In one embodiment, the positionally fixed bearing points 28, 29 of the double motion link mechanism 18 are spaced apart vertically from one another. The front bearing point 28 is situated below the rear bearing point 29. The two articulation points 32, 33 arranged at the free ends 30, 31 are likewise spaced apart vertically from one another. The front articulation point 32 is situated above the rear articulation point 33 in at least the initial position shown in FIG. 5, and in some embodiments, at all positions during travel.

In one embodiment, the two motion links 24, 25 are of different lengths. The front motion link 24 may be longer than the rear motion link 25.

In one embodiment, the axis of rotation 38 of the seat support 4 does not lie on the imaginary straight line formed by the two articulation points 32, 33. Instead, the axis of rotation 38 lies below said straight line, specifically approximately at the level of the articulation point 33 of the rear motion link 25, at least during almost the entire movement of the seat support 4 on the movement path 20.

Figure 5:
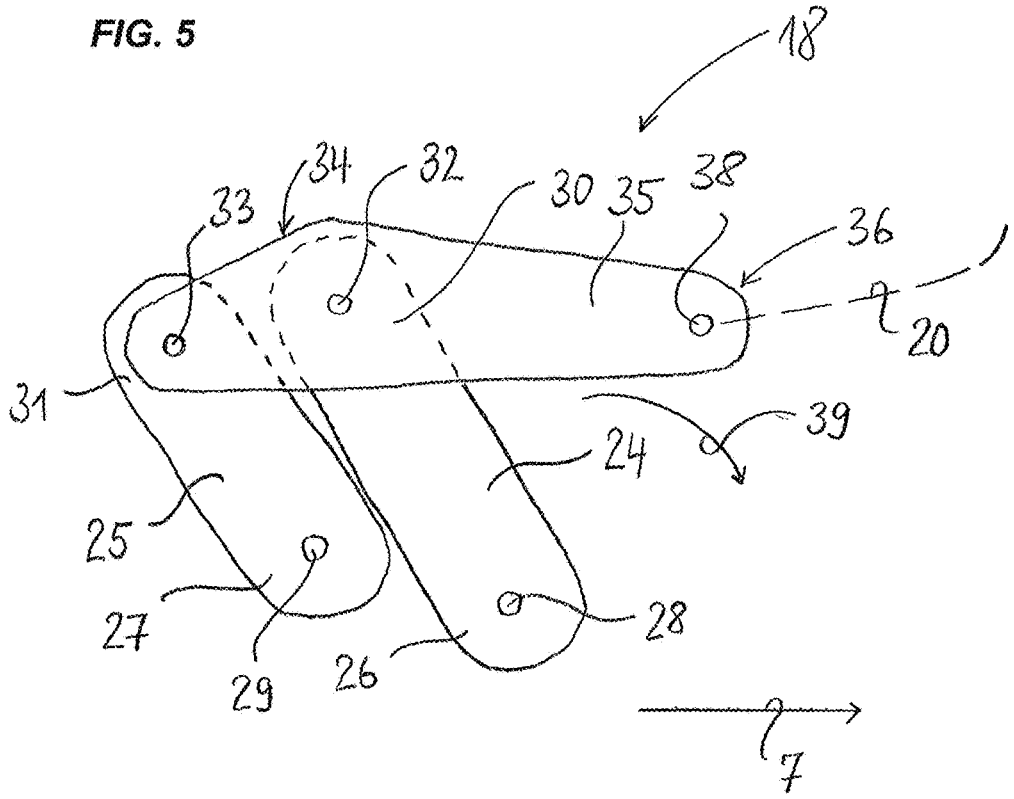
FIG. 5 shows a four-joint coupling mechanism, designed as a double motion link mechanism, in an initial position.

During a pivoting movement of the backrest support 5 in the rearward pivoting direction 19, the two motion links 24, 25 of the double motion link mechanism 18 perform a forward pivoting movement about their bearing points 28, 29, as indicated in FIG. 5 by arrow 39.

In the initial position shown in FIG. 5, in which the backrest support 5 is not subjected to load, that is to say is not pivoted rearward, the two motion links 24, 25 are arranged so as to be tilted rearward. The articulation points 32, 33 of the motion links 24, 25 are situated behind the bearing points 28, 29 of the respective motion link 24, 25. The articulation point 32 of the front motion link 24 is still situated in front of the bearing point 29 of the rear motion link 25.

Figure 8:
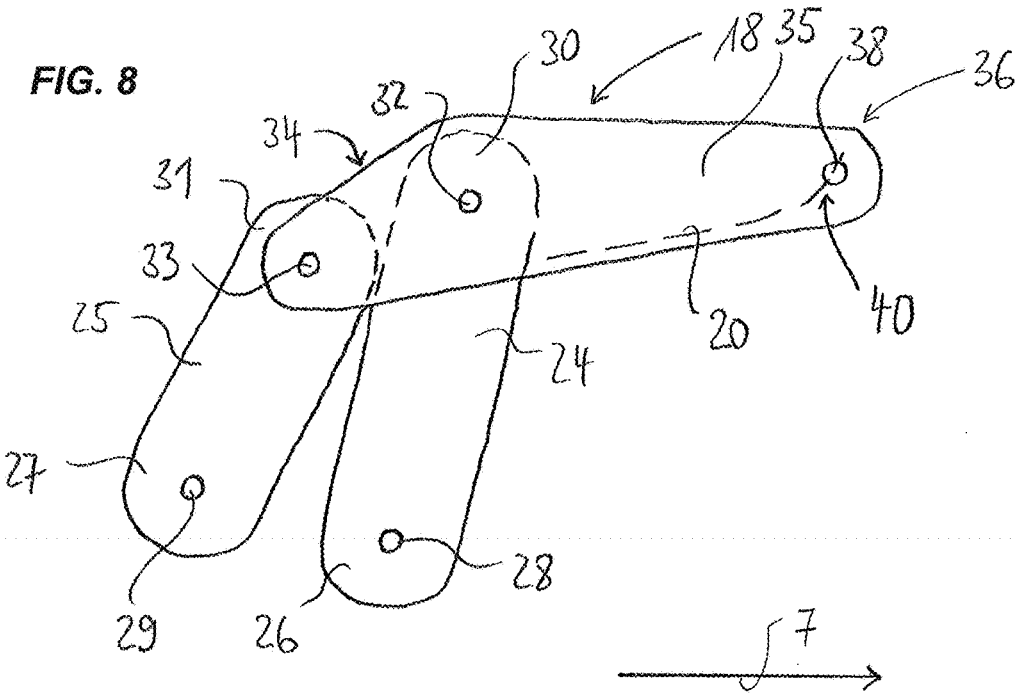
FIG. 8 shows the four-joint coupling mechanism from FIG. 5 in an end position.

In the end position shown in FIG. 8, in which the backrest support 5 has been pivoted rearward to the greatest possible extent, the two motion links 24, 25 are arranged so as to be tilted forward. The articulation points 32, 33 of the motion links 24, 25 are situated in front of the bearing points 28, 29 of the respective motion link 24, 25. The articulation point 33 of the rear motion link 25 is still situated in front of the bearing point 28 of the front motion link 24.

In all positions of the double motion link mechanism 18, the articulation point 32 of the front motion link 24 can be situated above the articulation point 33 of the rear motion link 25.

The double motion link mechanism 18 is designed such that, during a rearward pivoting movement of the backrest support 5, the axis of rotation 38 of the seat support 4 moves forward on a substantially rectilinear movement path 20.

During the forward pivoting movement of the motion links 24, 25, the articulation points 32, 33 pass over the bearing points 28, 29 of the respective motion link 24, 25. The coupling element 34 and thus the axis of rotation 38 of the seat support 4 move substantially on a straight line for a majority of the movement path 20. The relative position of the axis of rotation 38 of the seat support 4 with respect to the articulation point 33 of the rear motion link 25 remains virtually unchanged.

Figure 6:
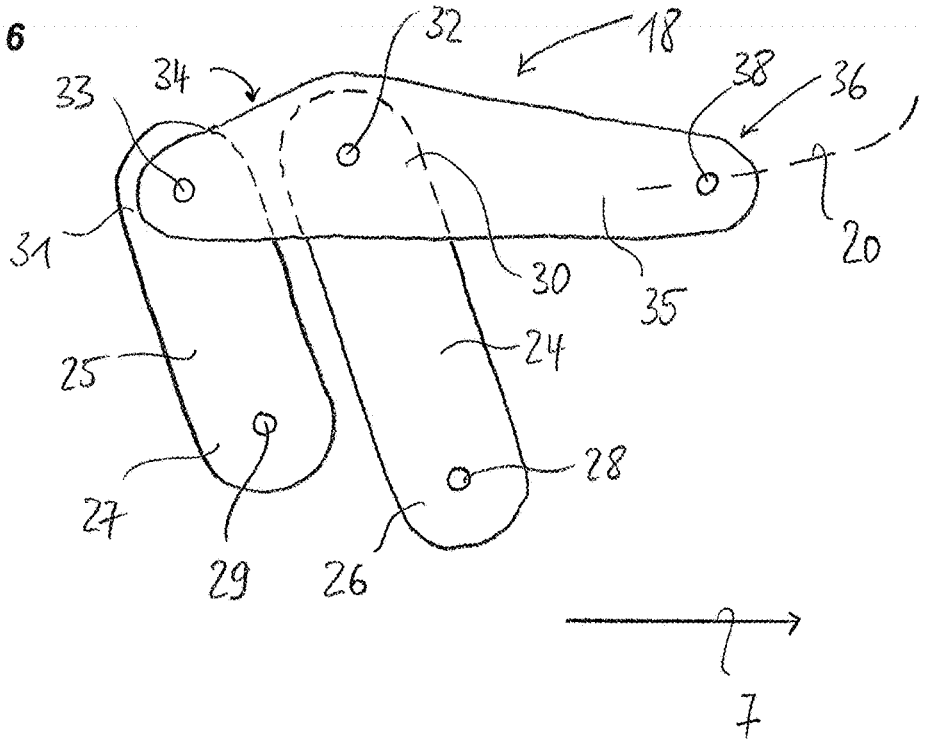
FIG. 6 shows the four-joint coupling mechanism from FIG. 5 in a first intermediate position.
Figure 7:
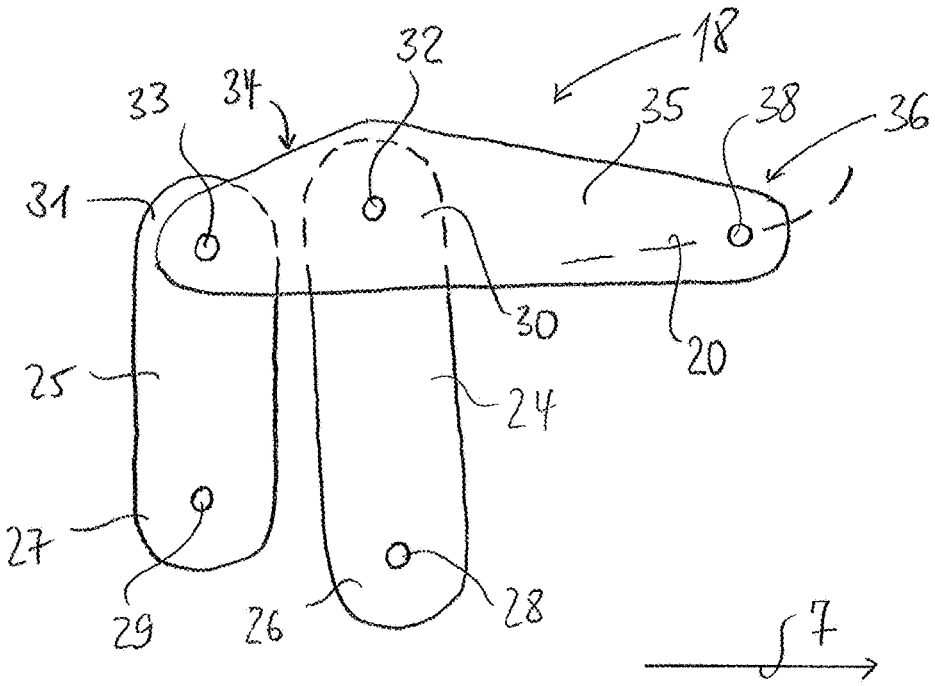
FIG. 7 shows the four-joint coupling mechanism from FIG. 5 in a second intermediate position.

The substantially rectilinear movement path 20 may be inclined with respect to the horizontal and runs with a uniform upward inclination in the forward chair longitudinal direction 7, as shown by way of the intermediate positions in FIGS. 6 and 7. In this case, the movement path 20 encloses an angle of approximately 13 degrees with the horizontal.

A pivoting movement of the backrest support 5 from the initial position into the rearwardly pivoted position is associated with an immediate lifting movement of the seat support 4 with a slight forward inclination. The seat support 4 is thus driven along synchronously in a defined relationship with respect to the backrest support 5, with a slight tilting of the seat surface. This gives rise to the desired synchronous effect in which the angle of the seat support 4 relative to the backrest support 5 changes.

The weight of the user has a direct effect on the pivoting resistance of the backrest support 5 which is perceptible to the user. A user of low weight has to overcome a considerably lower pivoting resistance when pivoting the backrest support 5 than a heavy user. This has the effect that, subjectively, every user experiences the same "perceptible" resistance when pivoting the backrest support 5.

In the illustrated embodiment, the double motion link mechanism 18 is designed such that, shortly before the end position of the two motion links 24, 25 illustrated in FIG. 8 is reached, the movement path 20 of the axis of rotation 38 of the seat support 4 assumes an end profile which deviates from its substantially rectilinear profile with uniform upward inclination in the forward direction, and abruptly rises steeply. Said range of the movement path is denoted in FIG. 8 by arrow 40. In this way, the user experiences a type of braking effect, as they feel an increased resistance. The movement of the seat support 4 induced by the pivoting movement of the backrest support 5 is braked directly before the end position is reached. The axis of rotation 38 of the seat support 4 changes its relative position with respect to the articulation point 33 of the rear motion link 25. In the end position of the two motion links 24, 25, the axis of rotation 38 of the seat support 4 is now situated above the articulation point 33 of the rear motion link 25, and even above the articulation point 32 of the front motion link 24.

As used herein, a four-joint coupling mechanism is to be understood to mean a construction corresponding to a four-bar coupling gear unit which is, logically, composed of four interconnected elements, wherein the first gear element is formed by the base frame of the chair. The three further elements correspond to the input element, the output element, and the coupling element of a coupling gear, wherein, in the present case, the four-joint coupling mechanism does not perform the function of a gear unit but serves solely for the guidance of the seat support, which is connected to the coupling element, relative to the base frame, such that neither an input element nor an output element in the sense of a gear unit is provided.

The invention is not restricted to the exemplary embodiment. All of the features presented in the description, in the following claims and in the drawings may be essential to the invention both individually and in any desired combination with one another.

LIST OF REFERENCE NUMERALS

1 Office chair
2 Chair column
3 Base frame
4 Seat support
5 Backrest support
6 Connecting element
7 Chair longitudinal direction
8 Rear part of the base frame
8*a*,8*b* Chair arm
9 Pivot axis of the backrest support
10 Front part of the base frame
10*a*, 10*b* Extension
11 Receiving opening
12 (unused)
13 Lower shell
14 Upper shell
15 Front end of the seat support
16 Rear end of the seat support
17 Receiving chamber
18 Double motion link mechanism
19 Pivoting direction
20 Movement path
21 Opening
22 (unused)
23 Tension spring
24 Front motion link
25 Rear motion link
26 Bearing end of the front motion link
27 Bearing end of the rear motion link
28 Bearing point of the front motion link
29 Bearing point of the rear motion link
30 Free end of the front motion link
31 Free end of the rear motion link
32 Articulation point of the front motion link
33 Articulation point of the rear motion link
34 Coupling element
35 Arm
36 Free end of the arm
37 Actuation section
38 Axis of rotation of the seat support
39 Pivoting movement
40 End region of the movement path

The invention claimed is:

1. A chair (1), comprising:

a base frame (3);

a seat support (4); and a backrest support (5);

wherein the seat support (4) is connected to the backrest support (5), further, wherein the backrest support (5) is rotatably connected to a rear part (8) of the base frame (3), whereby a pivot axis (9) is defined about which the backrest support (5) is pivotable, and even further wherein the seat support (4) is connected to a front part (10) of the base frame (3) by a four-joint coupling mechanish (18), whereby the seat support (4) is moved on a defined movement path (20) in a chair longitudinal direction (7) during a pivoting movement of the backrest support(5), the defined movement path moving the seat support (4) forwardly and tilting a rear of the seat support downwardly, wherein the four-joint coupling mechanism comprises: a front motion link (24) and a rear motion link (25) rotatably mounted on the front part (10) of the base frame (3) to define positionally fixed front and rear bearing points (28, 29), whereas free ends (30, 31) of the motion links (24, 25) are rotatably connected to a movable coupling element (34) about respective front and rear articulation points (32, 33), which coupling element (34) has an arm (35) which extends forward as viewed in the chair longitudinal direction (7) and which is rotatably connected to the seat support (4), whereby an axis of rotation (38) of the seat support (4), which axis of rotation (38) is movable in the chair longitudinal direction (7) along the movement path (20), is defined.

2. The chair (1) according to claim 1, wherein the seat support is connected to the backrest support by a resilient connecting element.

3. The chair (1) according to claim 1, wherein the pivot axis (9) formed by connecting the backrest support (5) to the rear part (8) of the base frame (3) is positionally fixed.

4. The chair (1) according to claim 1, wherein a connecting element (6) connects the seat support (4) to the backrest support (5) such that a movement of one of the two supports induces a non-identical consequential movement of the respective other support.

5. The chair (1) according to claim 1, having at least one spring element (23) which connects the base frame (3) to the seat support (4).

6. The chair (1) according to claim 1, wherein the motion links (24, 25) perform a forward pivoting movement (39) about their respective bearing points (28, 29) during a rearward pivoting movement of the backrest support (5).

7. The chair (1) according to claim 6, wherein the four joint coupling mechanism (18) is designed such that, during a rearward pivoting movement of the backrest support (5), the axis of rotation (38) of the seat support (4) moves forward substantially rectilinearly.

8. The chair (1) according to claim 7, wherein the movement path (20) is inclined with respect to the horizontal.

9. The chair according to claim 1, wherein: the bearing points (28, 29) are spaced apart vertically from one another with the front bearing point (28) situated below the rear bearing point (29).

10. The chair according to claim 9, wherein: the articulation points (32, 33) arranged at the free ends (30, 31) are spaced apart vertically from one another during all points of travel, with the front articulation point (32) situated above the rear articulation point (33).

11. The chair according to claim 1, wherein: the axis of rotation (38) of the seat support (4) does not lie on an imaginary straight line formed by the two articulation points (32, 33).

12. The chair according to claim 1, wherein: the axis of rotation (38) lies approximately at the level of the rear articulation point (33) of the rear motion link (25), at least during almost the entire movement of the seat support (4) along the movement path (20).

13. The chair according to claim 1, wherein: when the backrest support (5) is not subjected to load, the two motion links (24, 25) are arranged so as to be tilted rearward, and when the backrest support has been pivoted rearward to the greatest possible extent, the two motion links (24, 25) are arranged so as to be tilted forward.

14. The chair of claim 1, wherein: the movement path (20) of the axis of rotation (38) of the seat support (4) assumes an end profile which deviates, from an initially substantially rectilinear profile with uniform upward inclination in the forward direction, to abruptly rise steeply when the backrest support reaches the greatest possible extent of rearward pivot.

15. The chair of claim 14, wherein the axis of rotation (38) of the seat support (4) changes relative position with respect to the rear articulation point (33) of the rear motion link (25) in an end position of the two motion links (24, 25) such that the axis of rotation (38) of the seat support 4 is situated above the rear articulation point 33.

16. The chair of claim 15, wherein, the axis of rotation (38) is disposed above the front articulation point (32) of the front motion link (24) when the backrest support has been pivoted rearward to the greatest possible extent.

17. A chair (1), comprising:

a base frame (3) having a front part (10) and a rear part (8);

a seat support (4); and a backrest support (5);

wherein the seat support (4) is connected to the backrest support (5) by a resilient connecting element such that a movement of one of the two supports induces a non-identical consequential movement of the respective other support, the backrest support (5) being rotatably connected to the rear part (8) of the base frame (3) at a pivot axis (9), the seat support (4) being connected to a front part (10) of the base frame (3) by a four-joint coupling mechanism (18) that includes a front motion link (24) and a rear motion link (25) rotatably mounted on the front part (10) of the base frame (3) to define positionally fixed front and rear bearing points (28, 29), free ends (30, 31) of the motion links (24, 25) being rotatably connected to a movable coupling element (34) about respective front and rear articulation points (32, 33), the coupling element (34) having an arm (35) which extends forward as viewed in the chair longitudinal direction (7) and which is rotatably connected to the seat support (4) at an axis of rotation (38) for the seat support (4), the axis of rotation (38) being movable in the chair longitudinal direction (7) along a movement path (20) during a pivoting movement of the backrest support(5), so the seat support (4) moves forwardly and a rear of the seat support tilts downwardly.

18. The chair according to claim 17 wherein: the bearing points (28, 29) are spaced apart vertically from one another with the front bearing point (28) situated below the rear bearing point (29), the articulation points (32, 33) arranged at the free ends (30, 31) are spaced apart vertically from one another during all points of travel, with the front articulation point (32) situated above the rear articulation point (33), and when the backrest support (5) is not subjected to load, the two motion links (24, 25) are arranged so as to be tilted rearward, and when the backrest support has been pivoted rearward to the greatest possible extent, the two motion links (24, 25) are arranged so as to be tilted forward.

* * * * *